US006370805B2

(12) United States Patent
Thompson

(10) Patent No.: US 6,370,805 B2
(45) Date of Patent: Apr. 16, 2002

(54) DECORATIVE MOUNTING CORNERS

(76) Inventor: Amy Thompson, 167 N. Gate Rd., Manchester, NH (US) 03104

( * ) Notice: Subject to any disclaimer, the term of this patent is extended or adjusted under 35 U.S.C. 154(b) by 0 days.

(21) Appl. No.: 09/468,021

(22) Filed: Dec. 20, 1999

(51) Int. Cl.[7] ..... A47G 1/06
(52) U.S. Cl. ..... 40/778
(58) Field of Search ..... 40/778, 159.1, 40/768

(56) References Cited

U.S. PATENT DOCUMENTS

| | | | | | |
|---|---|---|---|---|---|
| 852,018 | A | * | 4/1907 | Engel | 40/778 |
| 1,407,177 | A | * | 2/1922 | Stone | 40/778 X |
| 3,893,252 | A | | 7/1975 | Chase | |
| 3,987,569 | A | | 10/1976 | Chase | |
| 3,994,088 | A | | 11/1976 | Ohfugi | |
| D243,989 | S | | 4/1977 | Cohen | |
| D305,703 | S | | 1/1990 | Wang | |
| D306,529 | S | | 3/1990 | Goodell | |
| D312,836 | S | | 12/1990 | Svee | |
| 4,991,330 | A | * | 2/1991 | Heidari | 40/778 X |
| 5,025,581 | A | | 6/1991 | Polzin | 40/594 X |
| 5,373,654 | A | | 12/1994 | Whalen | |
| D404,074 | S | | 1/1999 | Sarriugarte et al. | |
| 5,855,155 | A | | 1/1999 | Weissenberger et al. | |

FOREIGN PATENT DOCUMENTS

| | | | | |
|---|---|---|---|---|
| EP | 0864443 A1 | | 9/1998 | |
| EP | 0864503 A2 | | 9/1998 | |
| FR | 693498 | * | 11/1930 | 40/159.1 |
| WO | WO 98/25769 | | 6/1998 | |

OTHER PUBLICATIONS

Archival–Safe Photo Corners Flyer from 3L Corp., 1120–B Larkin Drive, Wheeling, IL 60090–0247 (Undated).

University Products Catalog, University Products, Inc., pp. 38 and 86 (Undated).

* cited by examiner

*Primary Examiner*—B. Dayoan
*Assistant Examiner*—William L. Miller
(74) *Attorney, Agent, or Firm*—Robert R. Deleault, Esq.; Mesmer & Deleault, PLLC

(57) ABSTRACT

A mounting corner having a top piece and a bottom piece that are sealed together along their coextensive outside edges forming a pocket. A portion of the outside edges of the top piece and the bottom piece are rounded for accepting round-cornered memorabilia. An adhesive layer may be disposed on the outside surface of the bottom piece.

14 Claims, 5 Drawing Sheets

DECORATIVE MOUNTING CORNERS

BACKGROUND OF THE INVENTION

1. Field of the Invention

The present invention relates generally to an apparatus for mounting photographs, illustrations, post cards, certificates, documents, artwork, trading cards and other memorabilia with rounded corners onto a surface using mounting corners. Particularly, this invention relates to decorative mounting corners that are rounded and can be used to create scrapbooks, photograph albums, mounting boards and other similar display items onto which memorabilia with rounded corners are then removably displayed by slipping the corners of the memorabilia into the decorative mounting corners that have been adhered to the display item in the desired position.

2. Description of the Related Art

Various methods and means have been used to mount memorabilia into photograph albums and scrapbooks. Liquid adhesives have been commonly used for a number of years, but they require considerable care and skill to be used properly. These can be messy and frequently damage the memorabilia the user is trying to preserve.

Other adhesives are liquid activated, requiring some sort of moistening before being used. These adhesives can also be messy and cause damage to the memorabilia.

Non-toxic stick adhesives are also common. These are very easy to use, but can be messy and end up on the memorabilia the user is trying to preserve.

Pressure sensitive adhesives placed on the back side of the memorabilia to be mounted have also been used, but these too have drawbacks. Great care must be taken with pressure sensitive adhesives to ensure that accidental contact between the memorabilia and the adhesive does not occur prior to the memorabilia being properly positioned. Once the memorabilia has come into contact with the pressure sensitive adhesive, it is often difficult, if not impossible, to move or reposition the memorabilia without damage.

U.S. Pat. No. 3,994,088 (1976, T. Ohfuji) discloses a photograph mount for an album. The photograph mount is made of a rectangular pasteboard coated with a non-drying adhesive material on both surfaces in the form of lines running parallel to one another and perpendicular to the filing side of the pasteboard. There are also lines of a second non-drying adhesive material near the filing side of the pasteboard running parallel to the filing side of the pasteboard. A synthetic resin film is press-adhered to the adhesive on one side of the pasteboard near the filing edge, then folded around the opposite edge and press-adhered to the adhesive on the other side of the pasteboard. Memorabilia is mounted in this invention by being placed between the non-drying adhesive and the synthetic resin film. However, some plastics are known to cause fading or discoloration to photographs after long periods of time. Additionally, the plastic film can reflect light, making it difficult to view the memorabilia due to glare from lighting in the room.

U.S. Pat. No. 3,987,569 (1976, M. Chase) discloses a means for mounting memorabilia in an accurate position by using a base with a layer of adhesive on at least one of its surfaces and a sectional release sheet overlying the adhesive. The release sheet is sufficiently thick so that when an initial section of the release sheet is removed, the memorabilia can be moved about on the remainder of the release sheet without adhesively contacting the exposed adhesive until the memorabilia has been accurately positioned. Once the memorabilia is accurately positioned, the memorabilia is pressed into contact with the initially exposed adhesive. The remainder of the release sheet is then removed and the memorabilia is pressed into contact with the remainder of the adhesive. A disadvantage of this device is that once a memorabilia item comes in contact with the adhesive, it is messy and difficult to remove the memorabilia without damage.

Currently, adhesive mounting corners are available, but only in a few colors, such as black, white, silver, gold and clear. Additionally, all the existing mounting corners are designed for mounting square-cornered items.

Therefore, what is needed is a mounting corner with a rounded outside edge portion that generally follows the contour of memorabilia having rounded corners. What is also needed is a mounting corner with a rounded outside edge portion that is self-adhesive. What is further needed is a mounting corner that can add color and/or decorative effect to the items being mounted. What is still further needed is a mounting corner that will not damage the memorabilia and that allows the mounted memorabilia to be easily removed without damage.

SUMMARY OF THE INVENTION

It is an object of the present invention to provide a mounting corner with a rounded outside edge portion that generally follows the contour of memorabilia having rounded corners.

It is a further object of the present invention to provide a mounting corner for users of all skill levels to removably mount memorabilia with rounded corners quickly and easily in a desired location in a scrapbook, photograph album or the like, and overcome the difficulties of the prior art.

It is another object of the present invention to provide a mounting corner that can be easily manufactured with archival-safe materials in a variety of colors and designs to add color and decorative effect to the memorabilia being mounted.

It is still a further object of the present invention to provide mounting corners of various sizes that can be used to accommodate various sizes and thicknesses of memorabilia.

Finally, it is an object of the present invention to provide a mounting corner having a layer of archival-safe, self-adhesive material on its bottom surface so as to eliminate the messiness of other types of adhesives.

The present invention achieves these and other objectives by allowing a user to display memorabilia with rounded corners in a non-permanent manner, allowing the memorabilia to be removed without damage.

The present invention is composed of a top piece of material and a bottom piece of material that have been joined together along a portion of their periphery, i.e. their outside edges, forming a pocket for receiving the corners of memorabilia. Both the front piece and the bottom piece have an exterior surface and an interior surface. The interior surface of both the top piece and the bottom piece are facing each other to form the pocket.

The top piece has a front edge and an outside edge with a rounded rear portion that generally follows the contour of round-cornered memorabilia. The top piece may also have a design either printed onto it, cut into it, pressed into it, attached to it, or punched from it to add further decorative effect to the mounted item, as in one preferred embodiment of this invention. Both the front edge and the outside edge of the top piece may be plain, or they may be decorative so as to add an aesthetically pleasing effect to the item being mounted.

The bottom piece also has a front edge and an outside edge with a rounded rear portion that generally follows the contour of round-cornered memorabilia. The bottom piece may have an adhesive layer on its exterior surface to make mounting quick and easy. Further, either the front edge or the outside edge, or both, may be cut into a decorative shape, if desired. The rounded rear portion of the top piece should be cut to the same design and dimension as the bottom piece, so these outside edges are coextensive once joined together.

In the preferred embodiment, the top piece is smaller than the bottom piece so that the front edge of the top piece transects the sealed periphery, along the opening of the pocket. However, both the top piece and the bottom piece may be of equal size, or the bottom piece may be smaller than the top piece. The top piece and bottom piece may be made of any suitable material such as polyethylene, prolypropylene and polyester. The material may be transparent, translucent or opaque.

The front and back pieces may be joined by pressing, heating, solvent bonding, gluing, or by simultaneously pressing them together along their coextensive outside edges while also applying heat to the material at this location. A portion of the sealed periphery of the present invention is rounded to generally follow the contour of memorabilia having rounded edges. The radii of these rounded portions may have any dimension, but preferably are either 0.25 inches or 0.50 inches.

The mounting corners of the present invention may be made in a variety of colors. Examples of some of these colors are blue, green, red, yellow, orange, purple, black, white, silver, gold or clear. These colors can be selected to match the mounting surface, or they can be selected to contrast or complement the mounting surface.

Additional advantages and embodiments of the present invention will be set forth in part in the detailed description which follows, and in part will be apparent from the descriptions, or may be learned by practice of the invention. References are made to the accompanying drawings which illustrate some preferred forms of the device of the present invention and wherein like characters of reference designate like parts throughout the drawings.

DETAILED DESCRIPTION OF THE PREFERRED EMBODIMENT

For the purposes of promoting an understanding of the principles of the invention, references will now be made to the preferred embodiment of the present invention as illustrated in FIGS. 1–8, and specific language used to describe the same. It will nevertheless be understood that no limitation of the scope of the invention is thereby intended. The terminology used herein is for the purpose of description and not limitation. Any modifications or variations in the depicted device, and such further applications of the principles of the invention as illustrated therein, as would normally occur to one skilled in the art to which the invention relates are considered to be within the spirit of the invention.

Figure 1:
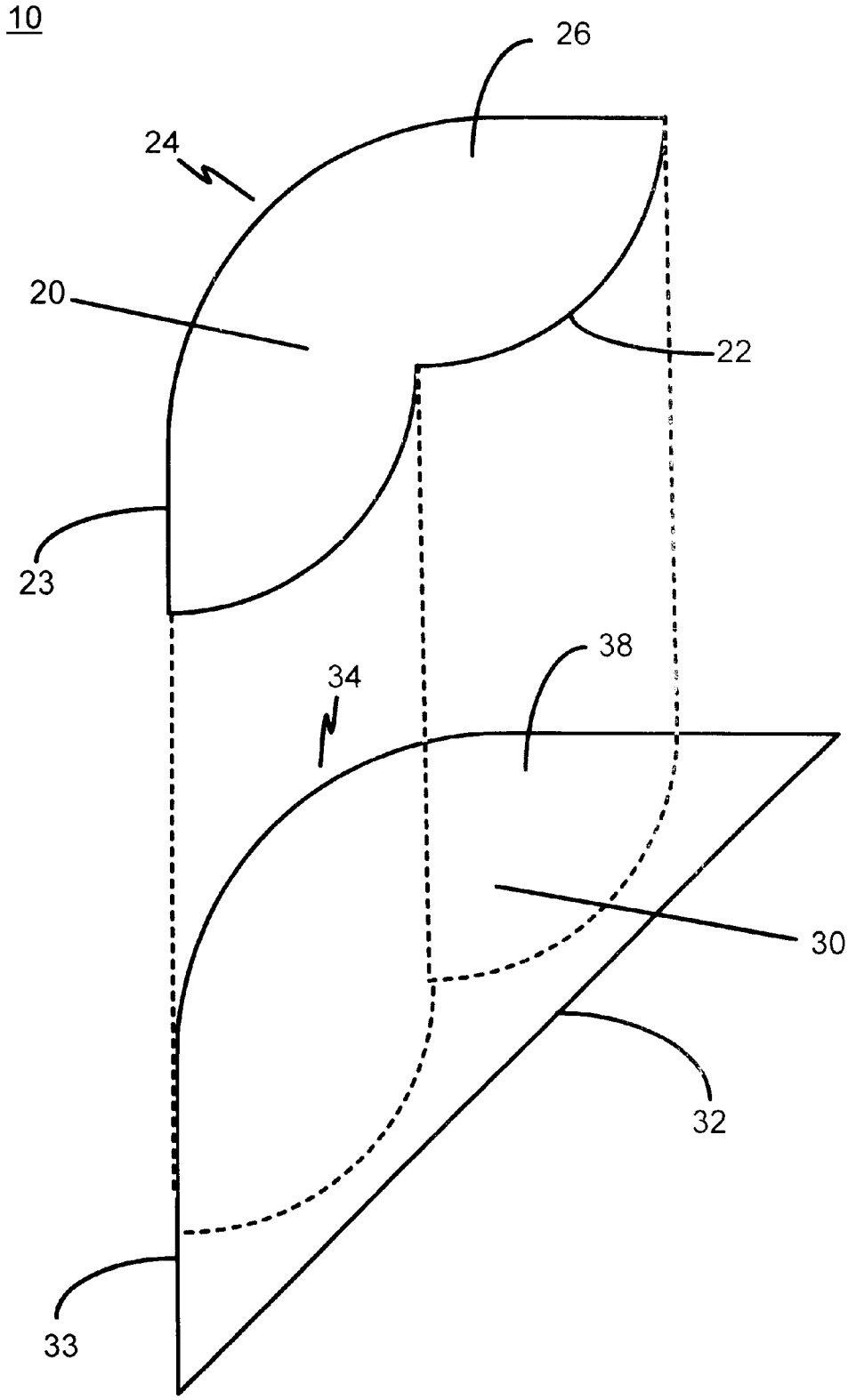
FIG. 1 shows an exploded view of the mounting corner seen in FIG. 3.

Referring now to FIG. 1, there is shown an exploded view of mounting corner 10, composed of a top 20 and a bottom 30. Top 20 has a top front edge 22, a top outside edge 23 with a rounded rear portion 24, a top exterior surface 26 and a top interior surface 28 (not shown). Bottom 30 has a bottom front edge 32, a bottom outside edge 33 with a rounded rear portion 34, a bottom interior surface 38 and a bottom exterior surface 36 (not shown).

Top 20 and bottom 30 are sealed together along their extensive outside edges 23 and 33, respectively, with top interior surface 28 facing bottom interior surface 38, to form pocket 50 (not shown), into which memorabilia can be inserted. As depicted, top 20 is smaller than bottom 30 so that top front edge 22 transects the sealed periphery, along the opening of pocket 50 (not shown). Mounting corner 10 may be made of any suitable material, preferably an archival-safe material such as polyethylene. Some examples of other suitable materials include archival-safe polyethylene, polypropylene, polyester, paper and cardboard.

Top 20 and bottom 30 are cut to their desired shape prior to being joined together. In the preferred embodiment of this invention, top outside edge 23 and bottom outside edge 33 are cut to either a ¼" or ½" rounded corner, both industry standard radii. Any other radius may also be made and used without deviating from the spirit of this invention. Top outside edge 23 and bottom outside edge 33 may also be formed with scissors or other cutting or punching devices.

Figure 2:
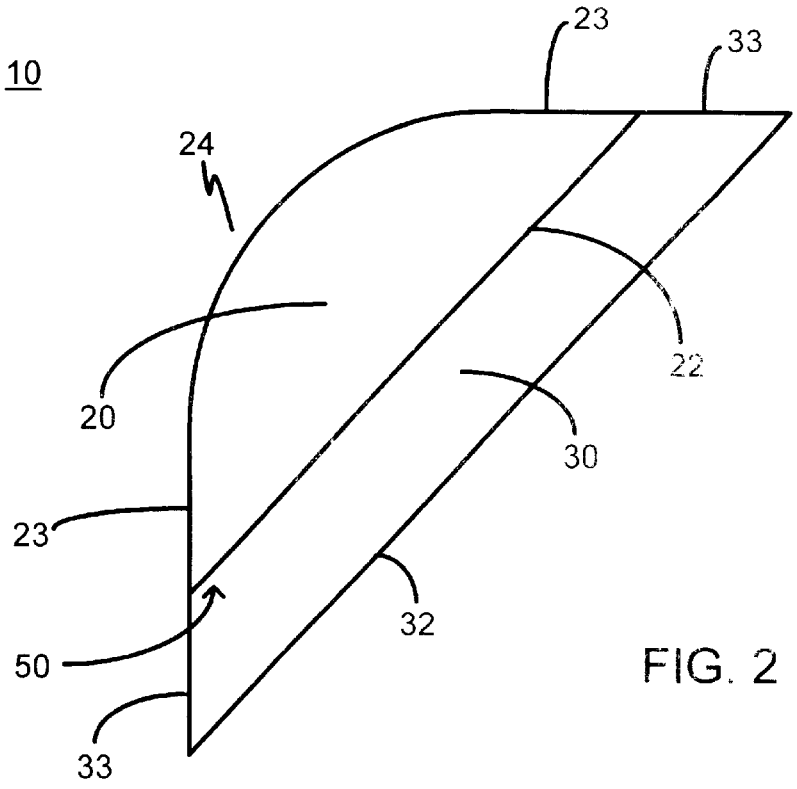
FIG. 2 is a front view of a preferred embodiment of the mounting corner showing the rounded rear portion of the outside edge.

Referring now to FIG. 2, there is shown a front view of mounting corner 10 with a plain top front edge 22 and a top outside edge 23 having a plain rounded rear portion 24. Mounting corner 10 is made of a top 20 and a bottom 30 that have been joined together along their coextensive outside edges 23 and 33, respectively, to form pocket 50. Top 20 and bottom 30 may be joined together to form mounting corner 10 in a variety of ways, preferably by pressing top outside edge 23 against bottom outside edge 33 while simultaneously applying heat to these coextensive outside edges 23 and 33. Some other examples of how top 20 and bottom 30 may be joined together along their coextensive outside edges 23 and 33 include pressing, heating, gluing and solvent bonding. Joining only these coextensive outside edges 23 and 33 together, while leaving top front edge 22 unattached from bottom front edge 32, forms pocket 50 into which memorabilia can be slipped.

Figure 3:
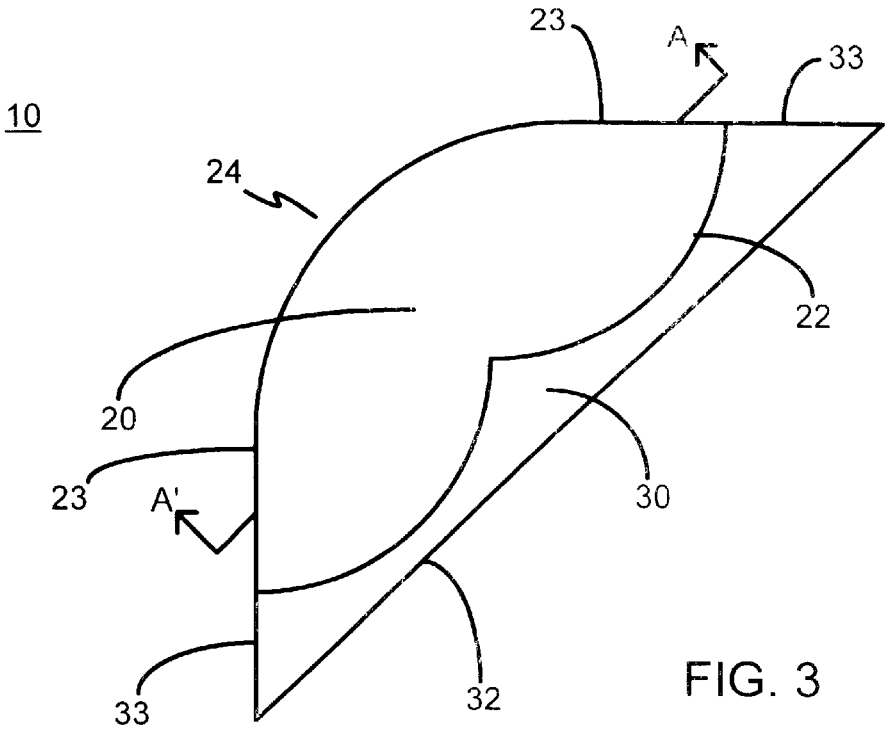
FIG. 3 is a front view of another embodiment of the mounting corner showing the rounded rear portion of the outside edge with a scalloped front edge.

Referring now to FIG. 3, there is shown a front view of mounting corner 10 with a scalloped top front edge 22, a top outside edge 23 having a plain rounded rear portion 24, and a plain bottom front edge 32.

Figure 4:
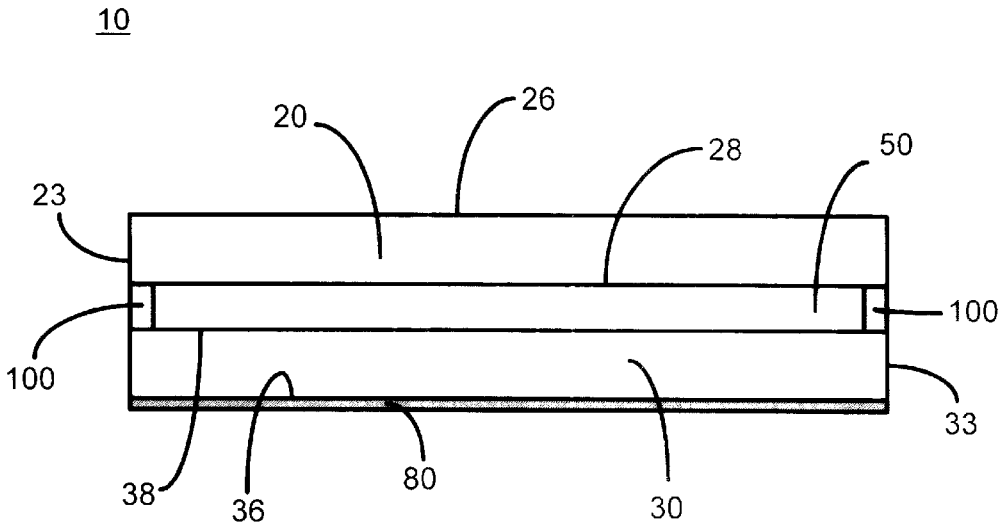
FIG. 4 is a cross-sectional view of the mounting corner along line A–A' in FIG. 3.

Referring now to FIG. 4, there is shown a cross-sectional view of mounting corner 10 as taken at line A–A' in FIG. 3. FIG. 4 is not shown to scale. Top interior surface 28 is shown facing bottom interior surface 38. Top 20 and bottom 30 are joined along their coextensive outside edges 23 and 33 to form pocket 50. Reference numeral 100 represents the joined coextensive edges. Adhesive layer 80 is disposed onto bottom exterior surface 36.

Figure 5:
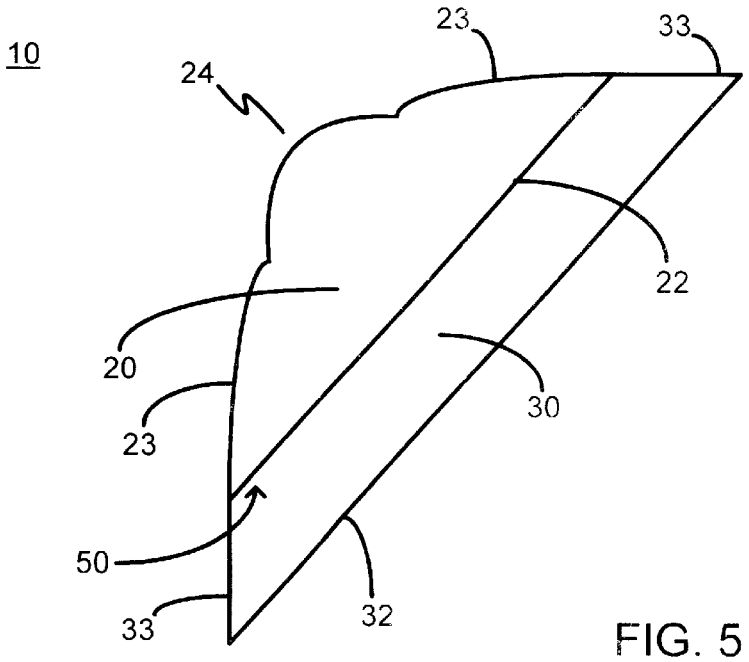
FIG. 5 is a front view of another embodiment of the mounting corner showing a mounting corner with a decorative rounded rear portion and a plain front edge.

Referring now to FIG. 5, there is shown a front view of mounting corner 10. In this embodiment of the present invention, top outside edge 23 has a decorative design cut into rounded rear portion 24, while top front edge 22 is left unadorned.

Figure 6:
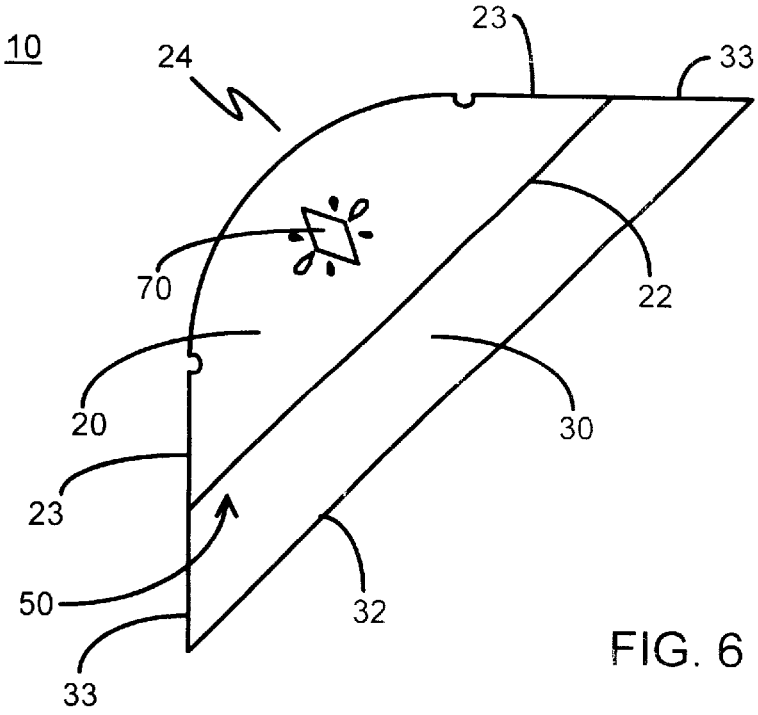
FIG. 6 is a front view of another embodiment of the mounting corner showing a decorative rounded rear portion, a design in or on the face, and a plain front edge.

Referring now to FIG. 6, there is shown a front view of mounting corner 10. In this embodiment of the present invention, top outside edge 23 has a decorative design cut into rounded rear portion 24, while top front edge 22 is left unadorned. Additionally, in the preferred embodiment of this invention design 70 is punched into top 20 prior to top 20 being joined to bottom 30. Design 70 may also be glued on, painted on, printed on, or pressed into top 20. Any combination of a decorative or non-decorative rounded rear portion 24 with any sort of decorative or non-decorative top front edge 22, with or without design 70, can be made, and all such embodiments are within the spirit of this invention.

Figure 7:
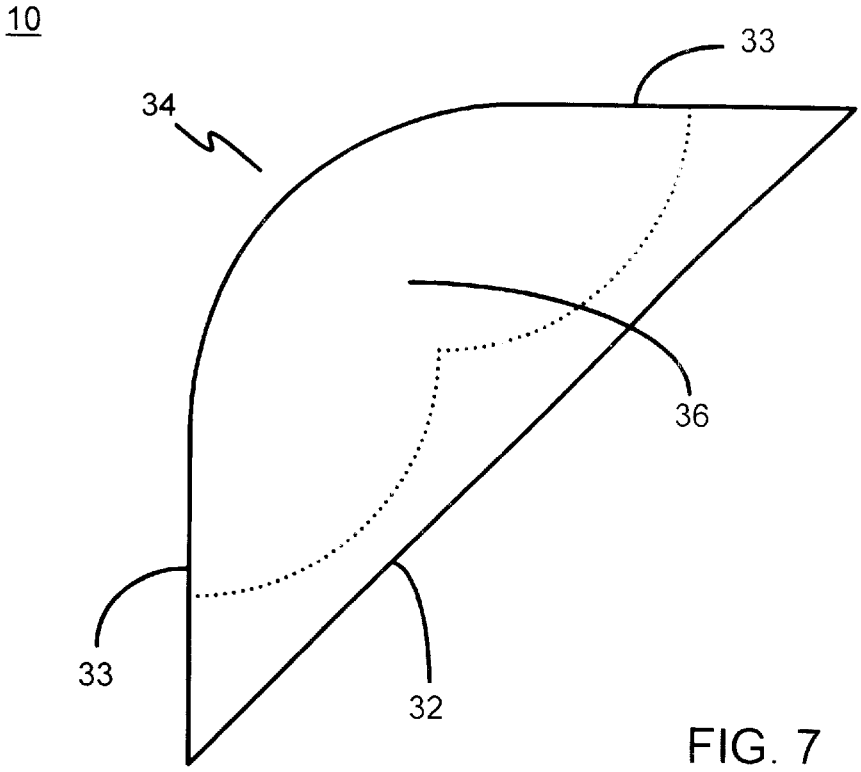
FIG. 7 is a back view of the mounting corner shown in FIG. 3.

Referring now to FIG. 7, there is shown a back view of mounting corner 10 showing bottom exterior surface 36. Bottom exterior surface 36 may have an adhesive layer 80 (not shown) on it. Preferably, adhesive layer 80 is a self-adhesive, non-yellowing acrylic pressure-sensitive adhesive. Adhesive layer 80 may also be made of other adhesives. Some examples of other adhesives include a neutral pH, water activated adhesive, a non-toxic stick adhesive, or a self-stick tape adhesive such as 3M 415 tape.

Figure 8:
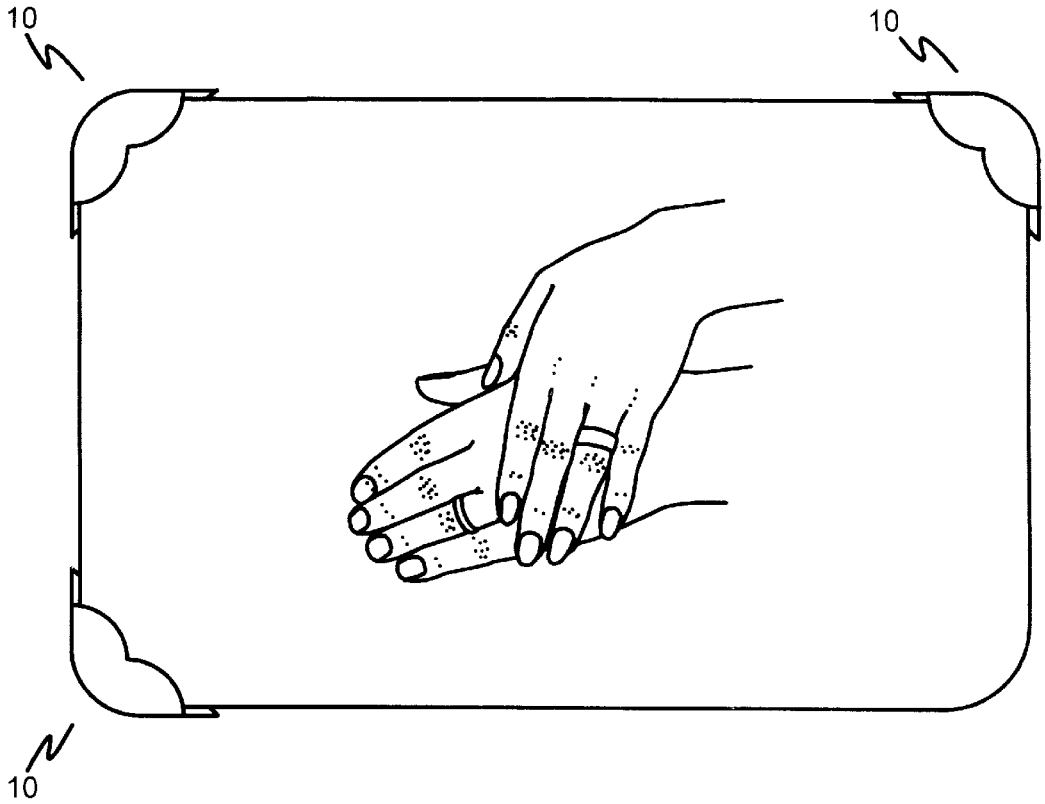
FIG. 8 shows a picture partially mounted with an embodiment of the mounting corner.

FIG. 8 shows a picture partially mounted with a preferred embodiment of mounting corner 10.

What is claimed is:

1. In combination, a mounting corner and substantially rectangularly-shaped flexible memorabilia having rounded corners, said combination comprising:

a top piece having a top front edge, a first top side edge, a second top side edge, and a rounded top rear portion between said first top side edge and said second top side edge, a top exterior surface and a top interior surface, wherein the tangent lines of said first top side edge, said second top side edge and said top front edge form a right triangle; and a bottom piece having a bottom front edge, a first bottom side edge, a second bottom side edge and a rounded bottom rear portion between said first bottom side edge and said second bottom side edge, a bottom exterior surface and a bottom interior surface, wherein said first top side edge, said second top side edge and said rounded top rear portion are aligned and attached to said first bottom side edge, said second bottom side edge and said rounded bottom rear portion forming said mounting corner wherein said rounded top rear portion is coextensive with said rounded bottom rear portion;

wherein said top piece and said bottom piece form said mounting corner which receives said rounded corner of said substantially rectangularly-shaped flexible memorabilia.

2. The combination of claim 1 wherein said bottom exterior surface is coated with an adhesive layer.

3. The combination of claim 2 wherein said adhesive layer is archival-safe.

4. The combination of claim 3 wherein said adhesive layer is selected from the group consisting of a self-stick, non-yellowing acrylic pressure-sensitive adhesive, a neutral pH, water activated adhesive, a non-toxic stick adhesive, and a self-stick tape adhesive.

5. The combination of claim 1 wherein said top front edge is arcuate shaped or scallop shaped.

6. The combination of claim 1 wherein said top piece contains at least one decorative design.

7. The combination of claim 1 wherein said first top side edge, said second top side edge and said rounded portion are arcuate shaped or scallop shaped.

8. The combination of claim 1 wherein said mounting corner is made of an archival-safe material.

9. The combination of claim 8 wherein said mounting corner is made of one or more materials consisting of polyethylene, polypropylene and polyester.

10. The combination of claim 1 wherein said top piece is colored.

11. The combination of claim 1 wherein said mounting corner is colored.

12. The combination of claim 1 wherein said top piece is opaque, transparent or translucent.

13. The combination of claim 1 wherein said mounting corner is opaque, transparent or translucent.

14. The combination of claim 1 wherein said aligned and attached edges have at least one notch.

* * * * *